US005176371A

United States Patent [19]

Rau et al.

[11] Patent Number: 5,176,371

[45] Date of Patent: Jan. 5, 1993

[54] ROTARY PRINTING MACHINE AND PRINTED WEB FOLDING AND HANDLING SYSTEM COMBINATION

[75] Inventors: Gunnar Rau, Künigsbrunn; Albert Heller, Pestenacker, both of Fed. Rep. of Germany

[73] Assignee: Man Roland Druckmaschinen AG, Offenbach, Fed. Rep. of Germany

[21] Appl. No.: 739,191

[22] Filed: Aug. 1, 1991

[30] Foreign Application Priority Data

Sep. 29, 1990 [DE] Fed. Rep. of Germany ..... 4030863

[51] Int. Cl.[5] ..... B41L 43/08

[52] U.S. Cl. ..... 270/42; 270/5; 270/41

[58] Field of Search ..... 270/5, 6, 40, 41, 42

[56] References Cited

U.S. PATENT DOCUMENTS

| | | | |
|---|---|---|---|
| 3,948,504 | 4/1976 | Woessner | 270/41 |
| 4,779,859 | 10/1988 | Knauer . | |
| 5,016,863 | 5/1991 | Birkmair | 270/41 |

FOREIGN PATENT DOCUMENTS

| | | | |
|---|---|---|---|
| 0019202 | 11/1980 | European Pat. Off. . | |
| 668877 | 11/1938 | Fed. Rep. of Germany . | |
| 724900 | 9/1942 | Fed. Rep. of Germany . | |
| 7415546 | 4/1975 | Fed. Rep. of Germany . | |
| 2512368 | 9/1976 | Fed. Rep. of Germany . | |
| 2573403 | 5/1986 | France . | |
| 2586097 | 2/1987 | France | 270/5 |
| 2588253 | 4/1987 | France . | |
| 1299332 | 12/1972 | United Kingdom . | |

*Primary Examiner*—Edward K. Look
*Assistant Examiner*—John Ryznic
*Attorney, Agent, or Firm*—Frishauf, Holtz, Goodman & Woodward

[57] ABSTRACT

To ensure accurately aligned handling of a plurality of superposed webs (3, 4) forming a composite web, which is to be folded longitudinally twice, particularly to maintain alignment of the individual folded web portions for subsequent application of indices, month, or other date identification and the like, particularly for book and calendar printing, two longitudinally located folding triangle or formers (22, 40) are located, one immediately behind the other, in the path or stream of flow of the webs, in which the first one receives the webs, after lateral alignment and the like, from the printing machine, and the second one is rotated 90° with respect to the incoming web to the first folding former, and applies a second fold. This ensures that the web is always processed in a linear path without twist or lateral offset, thus ensuring alignment of the individual elements of the composite folded web (8). Preferably, the first one, in the flow of the web, of the folding formers (9, 22) is height-adjustable to accommodate different formats of receiving paper and ensuring that the folded edge will always be in a predetermined plane, which will be the plane of arrival of the folded products to the second folding former (11, 40), and provide a reference edge for subsequent handling apparatus, such as perforators or punches (14), a cutter (16) and belt transport systems (17,19).

16 Claims, 7 Drawing Sheets

ROTARY PRINTING MACHINE AND PRINTED WEB FOLDING AND HANDLING SYSTEM COMBINATION

Reference to related application, the disclosure of which is hereby incorporated by reference, assigned to the assignee of the present application:

U.S. Ser. No. 07/739,348, filed Aug. 1, 1991, RAU et al.

Reference to related publications, assigned, respectively, to a predecessor organization, and to the assignee of the present application:

German Patent 25 12 368, Kühnberger et al

European Patent 0 019 202, Lange.

Reference to related patent, the disclosure of which is hereby incorporated by reference, assigned to the assignee of the present application:

U.S. Pat. No. 4,779,859, Knauer.

FIELD OF THE INVENTION

The present invention relates to a rotary printing machine and paper handling combination, which is especially suitable for printing webs which will be cut and bound into books, calendars, or other assemblies in which precise relative positioning of the folded, subsequently cut subject matter is important to permit application of index markers and the like at predetermined positions.

BACKGROUND

When printing books and calendars, the subject matter at times is printed on sheets substantially wider than the eventual format. The paper being handled on which the print is applied, as well as the printing and subsequent processing, especially folding of a plurality of webs or plies of paper, can be similar to newspaper printing. There are some differences, however, since the respective single webs or plies, during movement over individual folders, have to be guided accurately until the combination sheets or webs or plies are supplied to a cutter. It is important that the sheets be fed free of creases, and without any relative shift or offset. This is particularly important if special cuts are to be made, for example index cuts, for thumb-indexing, for alphabetical, weekly or monthly indexing, or other marking. Such cuts or markers must be applied accurately with respect to the particular printed subject matter. There is a further difference between book and calendar printing and newspaper printing: Not only is there a difference in format and the variety of paper which is being used, but also the marked difference of the substantially lower number of signatures which are being printed than on newspaper presses.

The referenced German Patent 25 12 368, Kühnberger et al, describes a folder which has two longitudinal folder apparatus. A device to apply a cross cut and a cross fold is located between the two folders. A collecting system is also provided. The format and the number of pages to be handled can be changed. It has been found that the cross folding results in a bending of the printed material and, upon collection, the folded printed product is bent. A relative shift of the printing products, that is, of the layers of the printed products, may result.

European Patent 0 019 202, Lange, describes a folding system which permits formation of a double cross fold, besides other possibilities of folding. This arrangement permits wide flexibility and the formation of the folds which are frequently required. It does not, however, solve the problem of possible shift of the respective layers of the webs or plies of the webs with respect to each other.

The referenced U.S. Pat. No. 4,779,859, Knauer, assigned to the assignee of the present application, and the disclosure of which is hereby incorporated by reference, describes a longitudinal folding system which has a folding triangle or folding funnel which can be changed and repositioned by shifting the folding triangle in the direction of the inclination thereof. This arrangement is particularly suitable to generate printed products of different formats and has the advantage that the wrap angle, with which the web surrounds the folder supply or run-on roller, in advance of the folding triangle, remains the same even if the folding triangle or former is shifted. Thus, even upon shift of the folding triangle, the tension relationships with respect to the running web does not change. The system requires a good deal of space and, if two such folders are to be placed sequentially behind each other, in the path of travel of the running web, the space requirement to generate a double parallel fold, at times, cannot be met.

THE INVENTION

It is an object to provide a rotary printing machine combined with a paper or web handling system, which can fold the resulting printing web and especially a plurality of webs above each other, in which the folding system is simple, can handle various widths and types of paper webs, and particularly paper of different weight; which can easily handle different formats and can be readily re-adjusted to accomodate only small quantities of printed subject matter, of any given format, without requiring extensive re-adjustment, while feeding the output from the folders to subsequent apparatus units, such as punches, perforating tools and the like, with appropriate and accurate register.

Briefly, the folding and web or paper handling system has two longitudinal folding devices, positioned along the path of travel of the web, in which the downstream folding device is rotated by 90° with respect to the upstream folding device. Typically, the folding devices are folding formers, or folding triangles or funnels.

The system further is so arranged that the then twice folded paper is applied to subsequent units without twist and lateral offset. The first folding device, receiving the unfolded paper web from the printing machine, is height-adjustable; the second folding device can be fixed.

DRAWINGS

DETAILED DESCRIPTION

Figure 1:
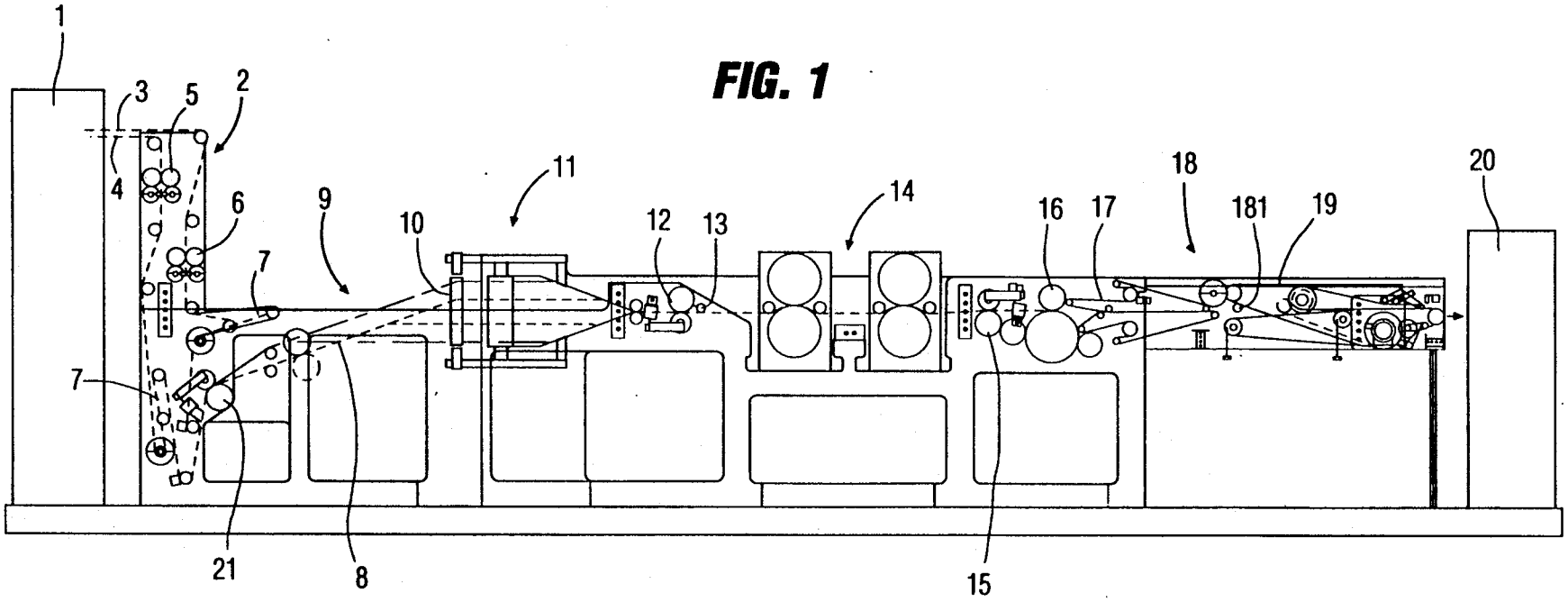
FIG. 1 is a highly schematic side view of a rotary printing machine system and paper handling arrangement in accordance with the present invention.

Referring first to FIG. 1, which, highly schematically, illustrates a rotary web printing press 1, which may be a printing system including the necessary number of printing stations. The printing system 1 is coupled to an edge seaming unit 2. The unit 2 is used to align the edges of two paper webs 3, 4 and includes motor driven cutting knives 5, 6. In the direction of travel of the web, in which the printing system 1 will be referred to as the upstream system, and subsequent units or systems as downstream units or systems, a unit 7 is provided which controls the cut register of the respective paper webs and, thus, accurately places the two webs 3, 4 above each other to form a multi-ply paper web 8. The present invention is not limited to the simultaneous handling of two paper webs, and the present invention does not depend on the specific number of webs to be placed above each other. Thus, and for purposes of illustration and for simplification of the description, the paper web 2 will be considered as a two-ply or two-layer web or web assembly. Hereinafter, whenever "paper web" is referred to, it is understood that a multi-layer or multi-ply assembly may be present.

The paper web 8 is conducted to a first longitudinal folding unit or device 9. The first longitudinal folding device 9 supplies the web 8 via a pair of inlet rollers 10 to a second longitudinal folding device or unit 11. The second unit 11 is not adjustable.

In accordance with a feature of the present invention, the longitudinal folding units or devices 9, 11 are rotated with respect to each other by 90°. Thus, the inlet guide roller system, for example guide roller 21, rotates about a horizontal axis; the inlet guide roller 10 for the unit or device 11 rotates about a vertical axis. The now twice longitudinally folded web 8 is then conducted to a first web pulling or tensioning unit 12, a safety cut-off or removal device 13, a paper processing station 14 with selective processing operations, for example perforation, cutting or the like, a second paper pulling or tensioning system 15, a cross cutter 16, a first belt distributor 17 to accelerate the printed products, a stabilizer 18, and a second sheet transport system 19, which is operable at a variable speed. The products are then further transported to subsequent handling stations 20, not forming part of the present invention, and hence only shown schematically.

Figure 2:
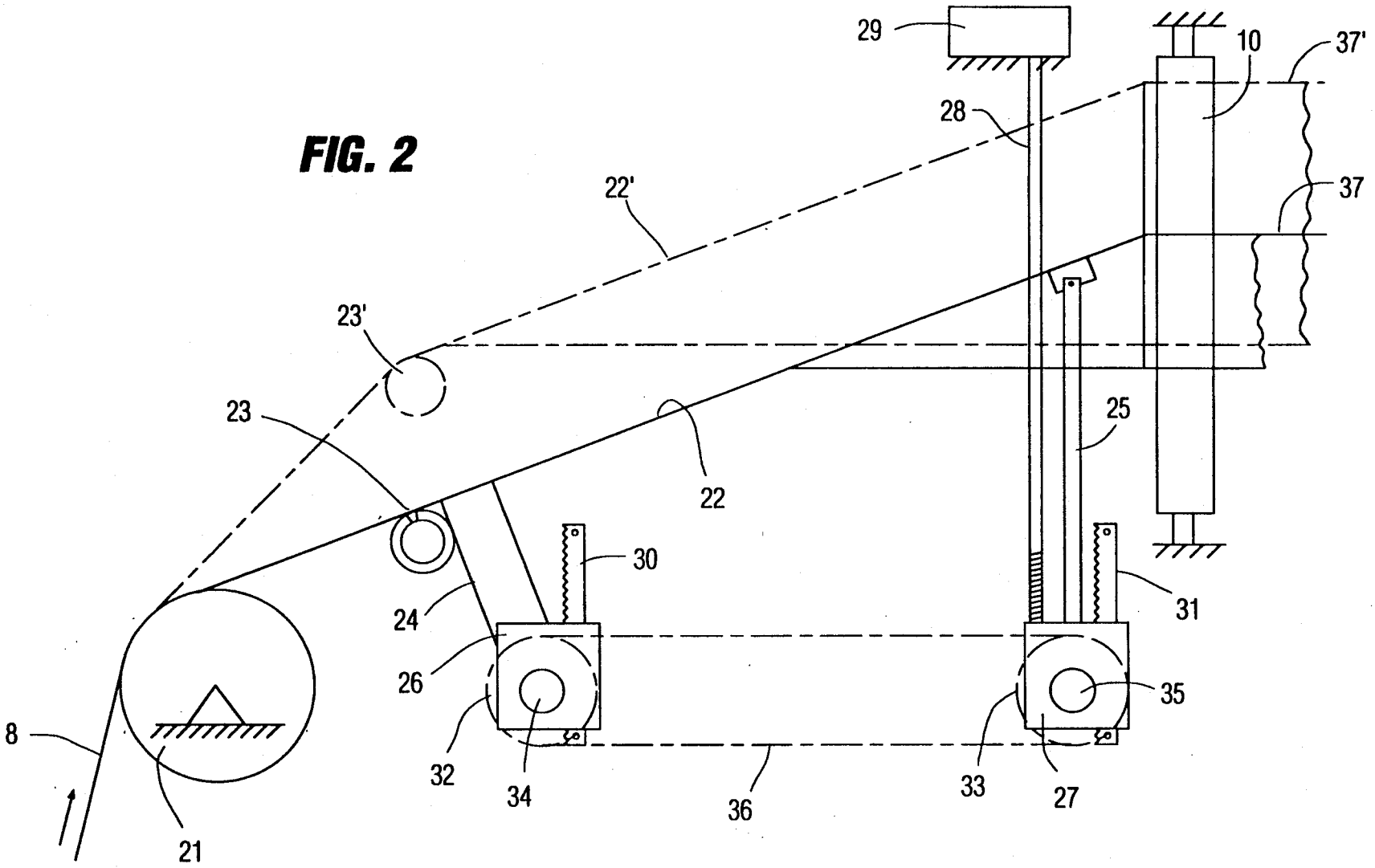
FIG. 2 is a schematic representation of the first longitudinal folding device.

FIG. 2 is a highly schematic representation of the construction of the first longitudinal folder 9. The cutting register control system 7 delivers the paper web 8 to a run-on roller or cylinder 21 which supplies the web to a first folding former or folding triangle or folding funnel 22. The folding funnel 22 has a folding tip which can be interchanged. It is not shown specifically since such folding formers are well known. An air-washed rod 23 is located in advance of the former 22 to reduce the friction of the paper web at the run-on portion or zone of the folding former, and thus improve the uniformity of the tension relationship or distribution across the paper web 8. Rather than using a rod 23 which is surrounded by air, to form an air bearing, a paper guide roller can be used at the inlet to the folding former 22 which, if desired, can be supplied with compressed air, to be emitted through circumferentially distributed holes.

In accordance with a feature of the invention, the first folding system 9 has a folding former 22 which can be vertically, or height-adjusted. The folding former 22 has coupling elements 24, 25 which support the former 22 on four vertically, or height-adjustable spindle bearings, of which only the spindle bearings 26, 27 are visible in FIG. 2. One of the four spindle bearings can be re-positioned by a threaded spindle 28, which is coupled to a motor drive 29. The three other spindle bearings are carried along on racks 30, 31, as known. Sprocket wheels 32 located at the run-on end of the former 22 and sprocket wheels 33 located at the run-off of the former 22 are coupled, respectively, with gear wheels 34, 35, which are in engagement with the gears of the racks 30, 31. Chains 36 are in engagement with the sprocket wheels 32, 33. Thus, upon rotation of the spindle 28 by motor 29, for vertical shifting, the entire former 22 is shifted with respect to height in a parallel shifting path. FIG. 2 illustrates, in chain-dotted representation, the former 22, in the position 22'. The air-washed or air bearing tube 23, secured to element 24, travels with the element 24, and hence with the former, and is shown in the raised position at 23'.

In the illustration selected, spindle 28 is shifted by motor drive 29. This permits control of the height of the former 22 from a remote-control console, and thus permits automatic or remotely controlled adjustment. Alternatively, of course, a hand wheel or the like can be used to rotate the spindle 25 or to adjust the position of the former 22 in another way.

The height adjustment of the first former 22 is so arranged that the folding edge 37 of the first folded web 8 is shifted towards an upper or lower level to such an extent that the edge will be at half of the difference of the paper width of the originally handled paper and the now folded paper web. Thus, the once folded paper web 8 can be so placed that, independently of the format to be generated, the center of the web shown in FIG. 3 at 38 will be in the same plane. That plane corresponds to a horizontal plane between the former run-out or pull-out rollers 41 from the second folding former 40 (see FIG. 3). The example which illustrates the adjustment of the position of the folding former 22' then will provide a center position 37' for the folding edge.

Figure 4:
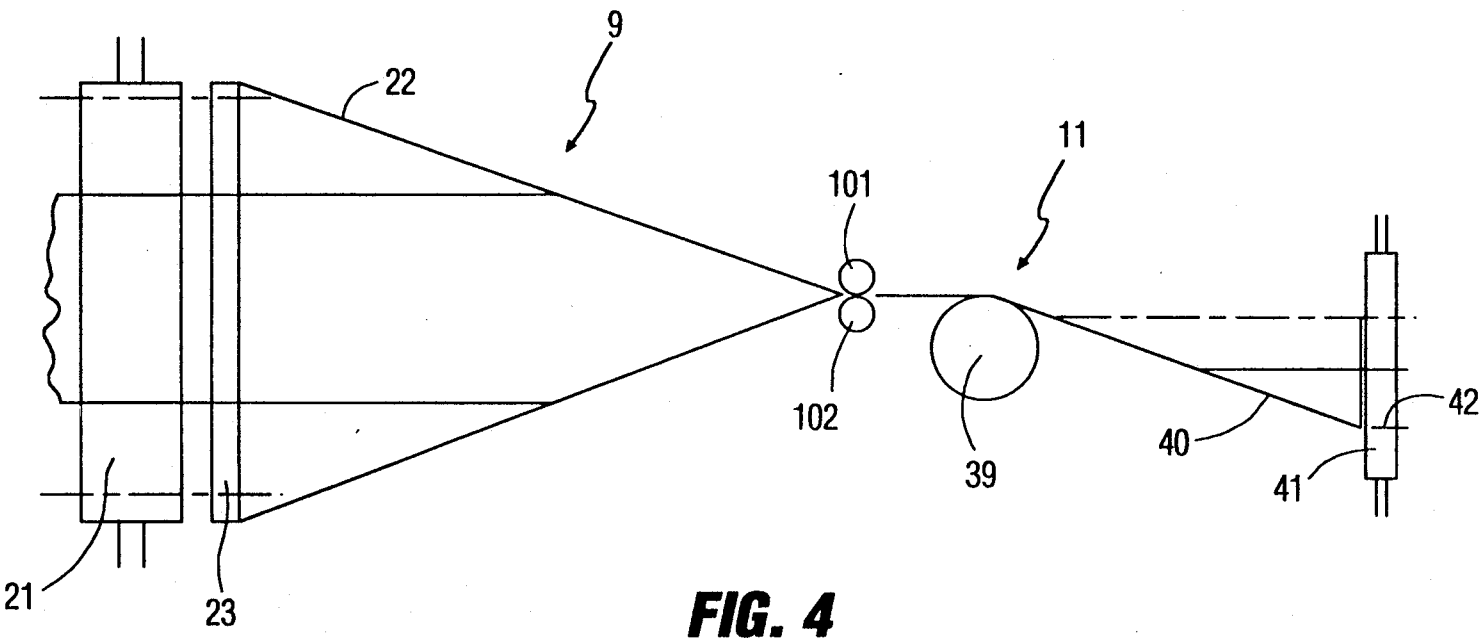
FIG. 4 is a top view, in schematic form, of the arrangement of the two longitudinal folding devices 9 and 11, as illustrated generally in FIG. 1.

The paper web which was passed over the first former 22 and has been folded thereby is then transported between two pull-off or run-out rollers, 101, 102 which, as can clearly be seen in FIG. 4, have axes of rotation perpendicular to the axis of rotation of the supply or run-on roller 21. The roller pair 10, formed by the rollers 101, 102, supplies the now once folded web 8 to the second longitudinal folding unit or device 11, in which the paper web 8 is longitudinally folded a second time.

Figure 3:
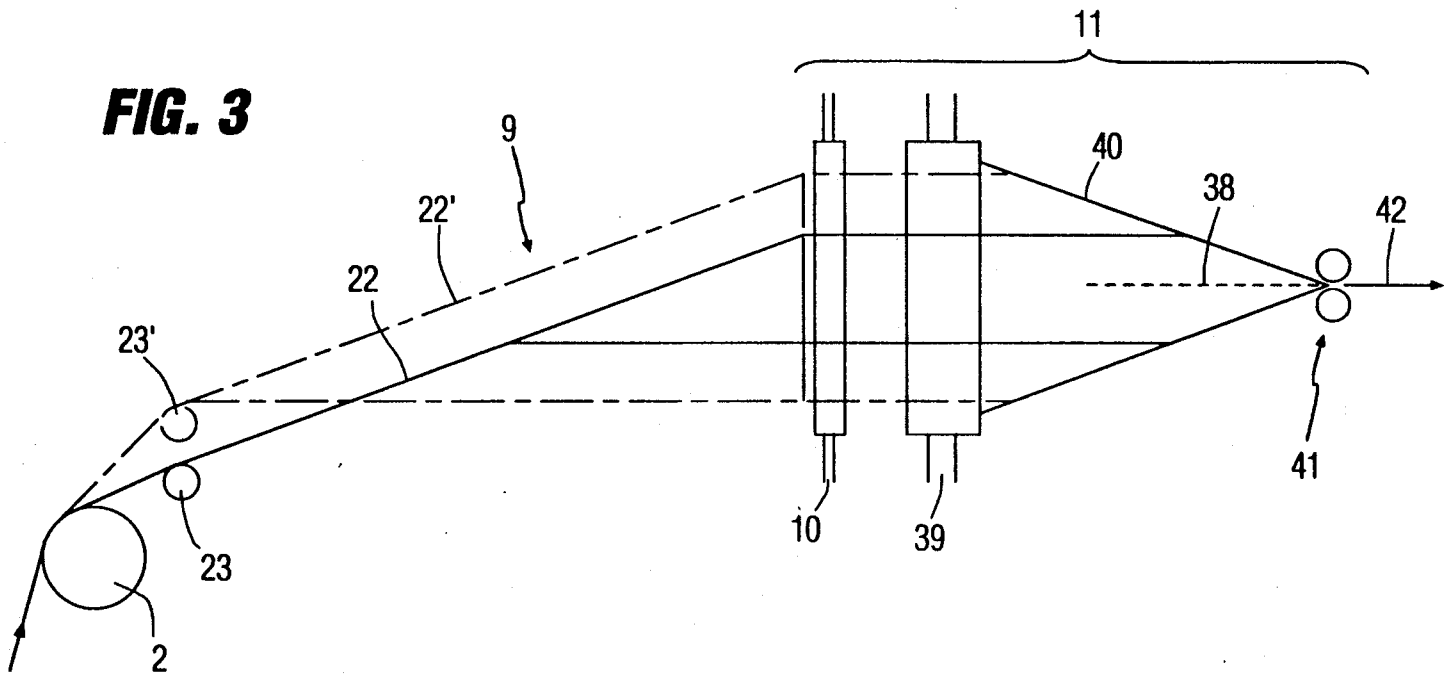
FIG. 3 is a schematic representation of the second folding device, in combination with the first folding device.

FIG. 3 illustrates the essential element of the second longitudinal folder 11, and, schematically and in abbreviated form, the first folder 9, so that the cooperation of the elements will be clear.

The second folder unit 11 has a run-on or inlet roller or cylinder 39, a second folding former or triangle or funnel 40, and a second run-out or pull-off roller pair 41. The pull-off roller pair 41 is adjustable in accordance with the characteristics of the paper web, for example the number of paper plies, the weight of the paper, thickness and the like. Inlet roller 39 and the pull-off roller pair 10 are immediately adjacent each other. The arrangement of the second folding former 11 is determined by two requirements:

(a) the second folding device 11 must be rotated, looked at in the direction of paper movement, by 90° with respect to the folding former 22. It does not matter whether it is rotated towards the right or to the left. The rotating requirement, however, is necessary to permit the folded paper web 8 to be so oriented that it can be supplied to the second run-on roller 39 without previously twisting the paper web. This permits placing roller 39 close to the pull-off rollers 101, 102, forming the pair 10, see FIGS. 3 and 4.

(b) The longitudinal folder 11 must be so arranged that the paper web 8 which is removed therefrom can be supplied to the next subsequent unit, here the pulling rollers 12, without twisting or lateral offset. This is particularly important since the composite paper web 8 then, only, can be guided without forming creases or undesired partial folds, and without causing any relative shifting of the respective layers or plies of the composite web 8 to further transport and handling apparatus.

The relative positioning and arrangement of the two longitudinal folders 9, 11 is such that the first run-out roller pair 10 of the first folding unit 9 is secured not to the first folding unit 9 but, rather, to the framework of the second longitudinal folder 11 which is fixed in the system. The system thus will be compact. The length of the rollers of the roller pair 10 removing the first folded web 8 from the first folder 9 should be designed to accomodate half the maximum width of the webs 3, 4 delivered from the printing machine system 1. Likewise, the run-on or supply roller 39 should be at least as long, and preferably somewhat longer than half of the width of the webs 3, 4.

In the arrangement illustrated in FIG. 1, the longitudinal folders 9, 11 are so arranged that the composite paper web 8 received from the unit 7 is guided in a plane which is perpendicular to the plane of the drawing. It is delivered from below and, after passing through the inlet run-on roller pair 21, is guided with preferably decreased inclination or slope about the air bearing rod 23. The air bearing rod 23 also extends in a plane perpendicular to the plane of the drawing. The folding former 22 is so placed that the web 8, or the web assembly or multiply web 8, is folded downwardly, that is, with its fold edge 37 forming the upper edge of the folded assembly. The folded paper web, then, will be moving in a plane which is parallel to the plane of the drawing. The second longitudinal fold is then so applied that the new folding edge 42 will point to one of the sides of the machine. As illustrated in FIGS. 3 and 4, the edge 42 points to the side of the printing machine visible in FIG. 1, that is, the operator accessible and control side of the printing machine.

In another embodiment, the arrangement can be so made that the second longitudinal folder is rotated to the left with respect to the longitudinal folder 9, and, then, the second longitudinal fold will have a folding edge 42', which faces away from the operating side of the printing machine, that is, faces the machine or drive side of the printing machine.

Figure 5:
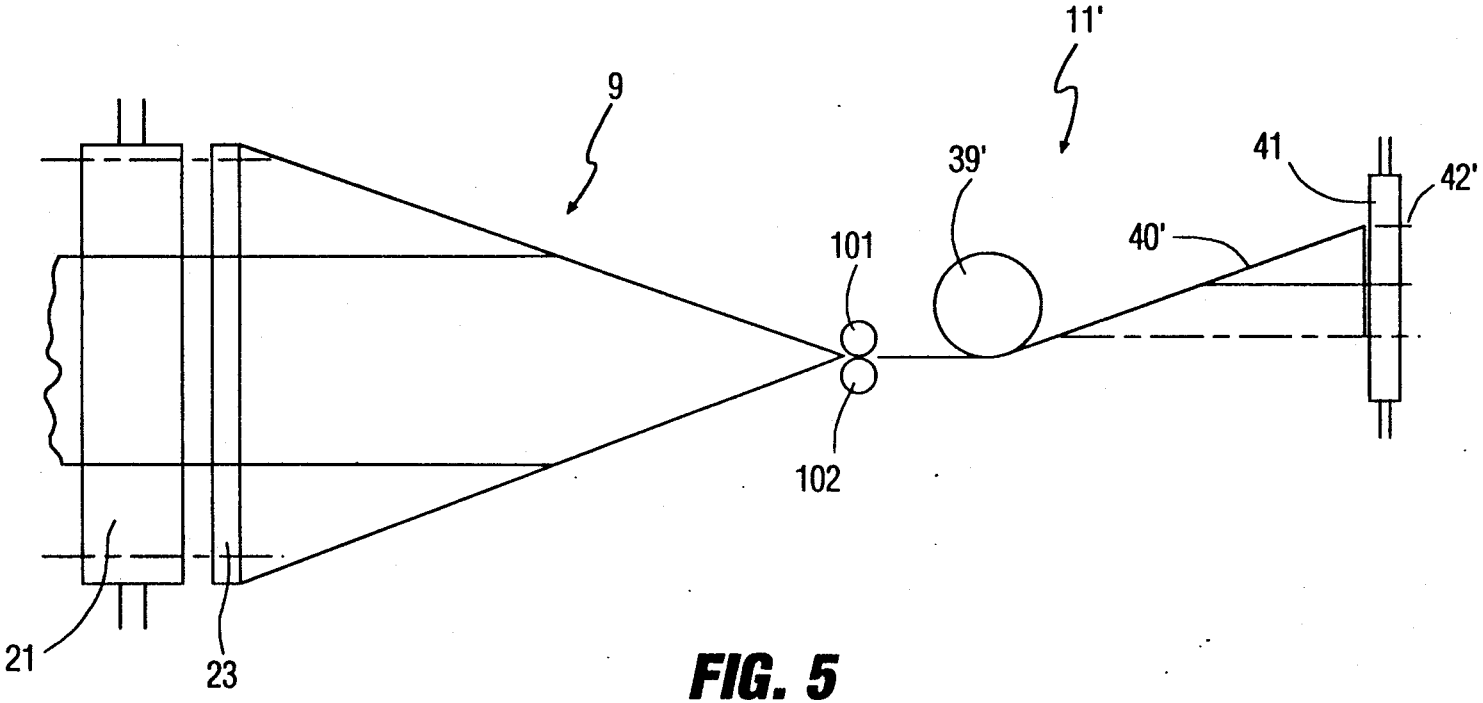
FIG. 5 is a schematic top view of the arrangement of the longitudinal folding devices 9 and 11 in a modified arrangement.

FIGS. 4 and 5 are top views of the arrangements of the longitudinal folders 9 and 11, in which, in FIG. 4, the second folding unit 11 is turned to the right with respect to the first folding unit 9, and in FIG. 5 the second folding unit 11' is turned to the left. The same reference numerals have been used in FIGS. 4 and 5; in FIG. 5, however, those elements which have been repositioned have been given prime notation. The folding edge 42, 42', respectively, will form a reference edge for the subsequent paper handling units. The selection whether the former 40 is to be in the position of FIG. 4, or in the position 40' of FIG. 5, will depend only on space availability and the spatial or geometric placement of the apparatus unit 20, for further paper processing, with reference to the paper feeding or supply systems 13–19.

A further alternative is provided by an essentially vertical arrangement of the two longitudinal folding systems 9, 11, in which the paper web 8 rises and drops substantially. This arrangement, also, can utilize the concept of the present invention, the only requirement being that the paper web, after leaving the second longitudinal folder 11, is transported without change in the plane of the paper web, and in an essentially linear path. Subsequent tension or pulling rollers, punching and perforating tools and the like which are touched by the paper web 8, can then be handled, reliably, without creases, intermediate folds and the like. This is particularly important when the paper stock is heavy and of higher volume, or if the paper web 8 has a high number of plies or layers. Rotating two sequentially arranged folding formers 90° with respect to each other permits such linear movement of the paper web, without twisting.

It is also possible to place the apparatus 7 which controls the cutting register in the printing machine at a level which is so high that the paper web 8 is guided from the system 7 downwardly, and the two longitudinal folding arrangements 9 and 11, then, are located rotated, each, 180° with respect to the embodiments shown. This, however, appears to be a less practical arrangement than that specifically described. The reverse arrangement, thus, also ensures, however, that the second longitudinal fold is so applied that the folding edge 42 is either facing the operator side of the printing machine or the machine or drive side thereof, that is, faces an observer looking at the printing machine in the direction of the representation of FIG. 1, or away.

FIGS. 4 and 5 also show that the second former system run-on or supply roller 39 is located on the opposite side of the paper web 8 as the folding former 40. This is contrary to the usual placement. The necessary tension can thus be obtained with a single roller. This has the advantage that, for one, the system can be more compact, and, further, that the paper is deflected only slightly and only once.

Referring again to FIG. 1: After passing the second folding unit 11, the paper web or web assembly 8 is pulled by pulling rollers or the pulling system 12 to the torn web or safety device 13, and then to a paper processing station 14. The paper processing or deformation station 14 is a selectively usable or exchangeable unit, which is so constructed that, in accordance with modular technology, different paper deformation tools can be inserted therein, in order to increase the versatility of the printing machine system, and the paper handling thereto. For example, a modular insert may be a punching device, an index puncher, a paper perforating device or other similar unit, as desired. Such structures are known in the paper handling industry; a preferred one is described in the referenced application Ser. No. 07/739,348, filed Aug. 1, 1991, Rau et al.

After passing a second paper tensioning and pulling unit 15, the web is cut in the paper cutter 16, making a cross-cut of the twice longitudinally folded web or web assembly 8. The now severed products are then supplied to an adjustable belt transport system 17.

Figure 6:
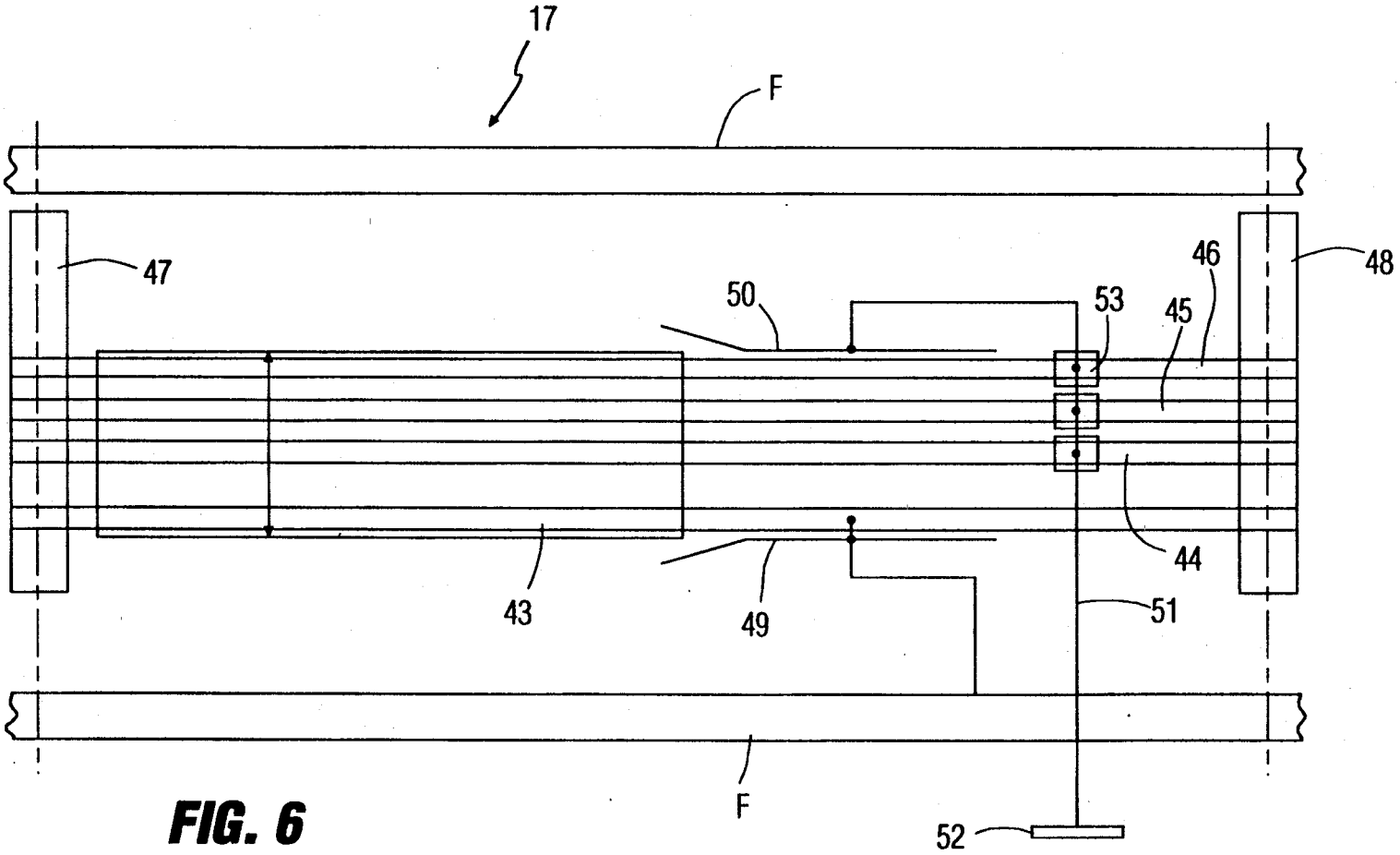
FIG. 6 is a highly schematic top view of the elements of an adjustable belt transport system, omitting all structural components not necessary for an understanding of the present invention.

Referring to FIG. 6, which illustrates the transport system 17 in greater detail: The basic object of the unit 17 is to ensure that the printed products, cross-cut by the cross-cutting unit 16, are reliably guided throughout their entire width, regardless of the format of the printed products. The transport system 17, which also has guidance and alignment functions, has a pair of transport belts 43, one above and one below the printed products, and positioned in an axially fixed location for rotation about the respective pulleys 47, 48. In addition, the system has three pairs of transport belts 44, 45, 46, which are axially adjustable along the respective pulleys 47, 48. FIG. 6, for better visibility and understanding of the invention, shows only the upper belts of the transport belt pairs 43 to 46.

The transport belts are endless belts, rotating about belt rollers, pulleys or cylinders 47, 48, providing both for drive and guidance of the upper and lower belts. In addition, the system has a fixed lateral guide unit 49, for example in form of a guide sheet or guide rail, and an adjustable lateral guide element 50. The fixed unit 49 is secured to a fixed frame element F, shown only schematically. The lateral guide element 50, which is adjustable, is coupled to an adjustment system for the axial positioning of the axially movable belts 44, 45, 46. "Axially" as herein referred to refers to the axis of rotation of the rollers or cylinders 47, 48. The system further includes an arrangement to properly position the axially movable belts 44–46, as well as the lateral guide element 50, in accordance with the requirements of the format of the cut paper products. This arrangement includes a spindle 51, formed with a thread or a worm gear, operated, for example, by a hand wheel 52 or, alternatively, by a motor, for example a stepping motor, and a group of belt guide rollers 53, one each for each one of the webs 44, 45, 46. Rotating the hand wheel 52, and hence the spindle 51, causes shifting of the rollers 53 along the axis of the spindle 51, and a consequent shifting of the movable lateral guide element 50, which is likewise coupled to the spindle drive, as only schematically shown in FIG. 6.

In an alternative arrangement, a group of spindles 51, with different pitch, can be coupled to the drive, for example the hand wheel 52, so that the spacing of the respective belts 44–46 will increase progressively as the width of the product increases, so that the product is guided, always at the edge, by one of the end rollers 53 closest to the lateral guide element 50 and, at uniform intermediate spacings, by the other belts 44, 45. The lateral guide element 50 can be coupled to the belt guide roller 53 which controls the position of the outermost belt pair 46.

The end return rollers or cylinders 47, 48 are driven, as well known, from the main drive of the printing machine, for example through suitable gearing; they could, also, be independently driven.

A stabilization unit 18 (FIG. 1) is located downstream of the belt transport system 17. The stabilization system 18 is positioned between the transport system 17 and a second transport system 19. The stabilization system 18 has a shaft on which a cam 181 is located, which is driven at the same speed as the first transport system 17. The purpose of the stabilization system is to ensure that each printed product is shifted rapidly and reliably, and therefore uniformly, is imbricated or overlapping position on the respective preceding printed product. This is particularly important when lightweight papers must be handled at high speed. The imbricated position is used, customarily, for appropriate further handling of the printed products, and to ensure that a uniformly spaced stream of overlapped products will be obtained.

Figure 7:
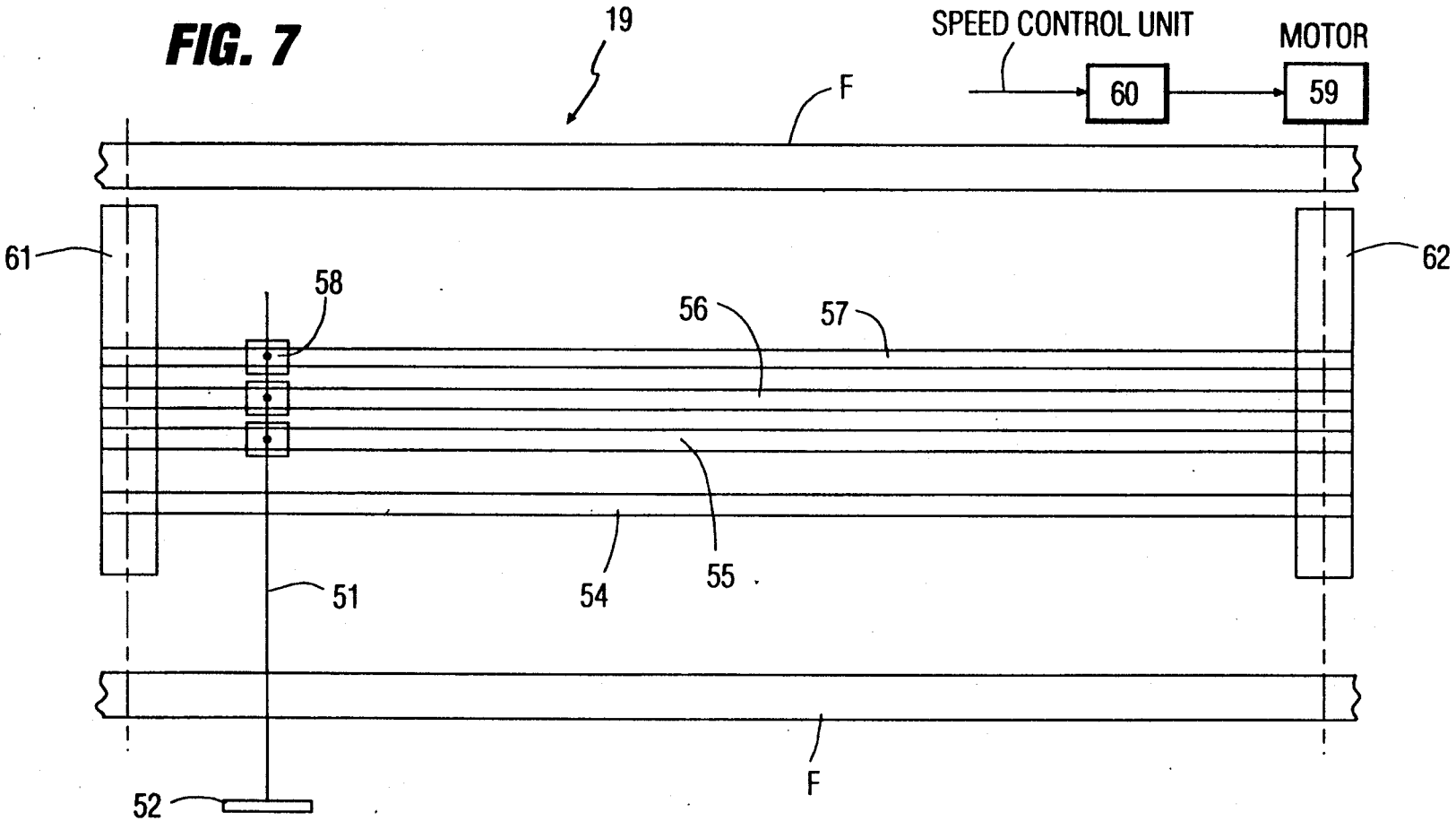
FIG. 7 is a schematic top view of the essential elements of an adjustable sheet transport belt system, omitting all elements not necessary for an understanding of the present invention.

FIG. 7, highly schematically, illustrates the second printed product transfer system which, to some extent, is similar to the first transport system illustrated in connection with FIG. 6. The second product transport system 19 has an axially fixed transport belt system pair 54 and three axially adjustable transport belt system pairs 55, 56, 57, running over respective turn-about rollers 61, 62, in which "axially" again refers to the axial position on the rollers 61, 62. The basic system is identical to that described in connection with FIG. 6, the first transport system 17. The transport belt pairs are similarly adjusted by belt adjustment rollers 58, the position of which is controlled by a suitable drive 52 via a spindle 51.

Differing from the system 17 of FIG. 6, the transport belt pairs 54 to 57 do not necessarily operate at printing machine speed, but at a suitably selected speed. Consequently, a speed controllable drive motor 59 is provided, coupled to one of the belt drive cylinders or rollers 61, 62, as shown to the roller 61, and speed-controlled by a speed control unit 60. To ensure accurate speed control, a feedback system can be used, not shown, as well known in the motor control field. This arrangement permits controlling or adjusting the speed of the belts 54 to 57 to be different from the speed of the belts 43–46 (FIG. 6). The speed of the belts 54–57 (FIG. 7) can be so controlled that the spacing of the imbricated or overlapped printed products can be selected in accordance with further handling requirements. Increasing the speed of the belts 54, 57 increases the spacing of sequential printed products; decreasing this speed results in decreased spacing of the printed products, and a tighter imbricating stack. The control unit 60, which can be an electronic control unit, can further be used in combination with a sensor sensing the spacing between adjacent printed products and controlling speed of the motor 59 such that the spacing between printed products remains the same, even if the speed of the passage of the paper web or web assembly 8 through the paper handling system 2–18 changes. This, then, permits easy adjustment of subsequent units 20, which can be set to handle paper products with uniform spacing, regardless of the speed of operation with which the web 8 passes through the machine.

Various changes and modifications may be made. The results obtained by the system in accordance with the present invention can be still enhanced or improved, for example by introducing a perforating apparatus between the lateral paper aligning and trimming unit 7 and the first longitudinal folder 9. Such a perforating apparatus provides perforations along the center of the paper web 8, which facilitates folding since air caught between the half-sheets which are folded together can escape through the perforations. This is particularly important when a substantial number of individual paper webs 3, 4 are to be folded together to a multiply fold, and especially if the paper handled is relatively thick and/or heavy. The perforations at the center or fold line, which will be the line passing over the nose of the folding former, provides for a preferred escape path for the entrapped air.

We claim:

1. For combination with a rotary web-type printing machine, a printed web folding and handling system, receiving a printed web (8) traveling in a direction from the printing machine, said printing machine being located, with respect to web travel, upstream of said folding and handling system in a downstream direction, said system having a first or upstream longitudinal folding device (9) comprising a first folding former or triangle (22), and a second longitudinal folding device (11) comprising a second folding former or triangle (44), located downstream of said first folding device, said longitudinal folding devices (9, 11) being positioned along the path of travel of the web, and an arrangement which provides a linear path of said web through said system, without twist or offset of said web, wherein the upstream folding device (9) is adjustable only in vertical direction;

the second folding device (11) is rotated by 90° with respect to said first folding device (9);

the first and second folding devices (9, 11) are located immediately adjacent each other in the path of travel of the web (8); and wherein said system further comprises a pair of pull-off rollers (10, 101, 102) located immediately downstream of said first folding former or triangle (22), and a run-on or supply roller (39) positioned immediately adjacent said first pair of pull-off rollers, and additionally immediately adjacent the second folding former or triangle (40), said system being devoid of any other rollers between said first and second folding triangles (22, 40).

2. The system of claim 1, wherein the second longitudinal folding device (11) is fixed in said system;

wherein said system further includes at least one further unit comprising at least one of: paper pulling or tensioning roller units (12, 15); paper web processing units (14, 16); paper transport units (17, 19); paper imbricating positioning units (18), and at least one subsequent paper processing station unit; and wherein the paper path from said downstream folding device (11) towards said paper web processing unit (20) is a longitudinal path devoid of introduction of twist or lateral shift or offset to said paper web in its path towards said paper web processing unit (20).

3. The system of claim 1, wherein the run-on or supply roller (39) of the second folding device is positioned on a side of the web which is opposite the side engaged by the second folding former or triangle (40).

4. The system of claim 3, wherein the run-out or pulling roller pair (10, 101, 102) is physically coupled to and forms part of the second folding device, whereby, upon vertical adjustment of said first or upstream folding device, said run-out or pulling roller pair will remain stationary with respect to the first folding former or triangle.

5. The system of claim 3, wherein said second longitudinal folding device (11) is fixed in said system.

6. The system of claim 1, wherein the run-out or pulling roller pair (10, 101, 102) is physically coupled to and forms part of the second folding device, whereby, upon vertical adjustment of said first or upstream folding device, said run-out or pulling roller pair will remain stationary with respect to the first folding former or triangle.

7. The system of claim 6, wherein said second longitudinal folding device (11) is fixed in said system.

8. The system of claim 1 wherein said second longitudinal folding device (11) is fixed in said system.

9. The system of claim 1, wherein said pair of pull-off rollers (10, 101, 102) have axes of rotation which are fixed in said system.

10. For combination with a rotary web-type printing machine, a printed web folding and handling system, receiving a printed web (8) traveling in a direction from the printing machine, said printing machine being located, with respect to web travel, upstream of said folding and handling system in a downstream direction, said system having a first or upstream longitudinal folding device (9) comprising a first folding former or triangle (22), and a second longitudinal folding device (11) comprising a second folding former or triangle (44), located downstream of said first folding device, said longitudinal folding devices (9, 11) being positioned along the path of travel of the web, and an arrangement which provides a linear path of said web through said system, without twist or offset of said web, wherein the second folding device (11) is rotated by 90° with respect to said first folding device (9);

the first and second folding devices (9, 11) are located immediately adjacent each other in the path of travel of the web (8); and further including means for vertically adjusting said first longitudinal folding device (9) to shift said device vertically, said vertically adjusting means including a threaded spindle (28);

drive means (29) coupled to said spindle for rotating the spindle;

rack means (30, 31) extending in a plurality of planes, each of which is perpendicular to the run-off direction of the web, after leaving the folding device;

gear means (34, 35) engageable with said rack means;

coupling means (32, 33, 36) coupling said gear means for synchronous, concurrent rotation;

bearing blocks (26, 27) retaining said gear means, one of said bearing blocks being coupled to said spindle (28);

and link means (24, 25) secured to spaced positions on the first folding former or triangle (22) and coupling said bearing blocks (26, 27) to the folding former or folding triangle, for shifting said folding former or folding triangle, without tilt or twist, in a direction parallel to the plane of the web (8), folded by the folding triangle or former and leaving said first folding triangle or former (22).

11. The system of claim 10, wherein said direction of the folded web (8) leaving said first folding former or triangle (22) is vertical, and said first folding former or triangle (22) is shifted in a vertical direction.

12. The system of claim 10, wherein said second longitudinal folding device (11) is fixed in said system.

13. The system of claim 10, wherein said system further comprises a pair of pull-off rollers (10, 101, 102) located immediately downstream of said first folding former or triangle (22), and a run-on or supply roller (39) positioned immediately adjacent said first pair of pull-off rollers, and additionally immediately adjacent the second folding former or triangle (40), said system being devoid of any other rollers between said first and second folding triangles (22, 40).

14. The system of claim 13, wherein said pair of pull-off rollers (10, 101, 102) have axes of rotation which are fixed in said system.

15. For combination with a rotary web-type printing machine, a printed web folding and handling system, receiving a printed web (8) traveling in a direction from the printing machine, said printing machine being located, with respect to web travel, upstream of said folding and handling system in a downstream direction, said system having a first or upstream longitudinal folding device (9) comprising a first folding former or triangle (22), and a second longitudinal folding device (11) comprising a second folding former or triangle (44), located downstream of said first folding device, said longitudinal folding devices (9, 11) being positioned along the path of travel of the web, and an arrangement which provides a linear path of said web through said system, without twist or offset of said web, wherein the upstream folding device (9) is vertically adjustable;

the second folding device (11) is rotated by 90° with respect to said first folding device (9);

the first and second folding devices (9, 11) are located immediately adjacent each other in the path of travel of the web (8);

the second longitudinal folding device (11) is fixed in said system;

wherein said system further includes at least one further unit comprising at least one of: paper pulling or tensioning roller units (12, 15); paper web processing units (14, 16); paper transport units (17, 19); paper imbricating positioning units (18), and at least one subsequent paper processing station unit (20);

wherein the paper path from said downstream folding device (11) towards said paper web processing station unit (20) is a longitudinal path devoid of introduction of at least one of: twist, lateral shift, and offset to said paper web in its path towards said paper web processing station unit (20); and wherein one of said paper web processing units comprises a cutter means (16) cutting said web into cut, printed products, and at least one belt or web transport unit (17, 19);

and wherein one of said paper transport units (17, 19) comprises a pair of transport belts (43, 54) in surface engagement with each other and rotating about spaced drive rollers (47, 48; 61, 62), at a fixed axial position about said rollers, the printed cut products being positioned between the surfaces of the transport webs or belts of a pair;

a plurality of additional transport belt pairs (44, 45, 46; 55, 56, 57);

and guide roller means (44, 45, 46; 55, 56, 57) engageable with respective ones of said further transport webs or belts, and axially adjustable, with respect to the axes of rotation of said drive rollers, for commonly shifting said further transport belt or web pairs in accordance with the format and size of the printed cut products being transported by said transport belt unit.

16. The system of claim 15, wherein said paper transport units comprise a first web or belt transport system (17);

a second web or belt transport system (19), said transport systems being located downstream of said cutting device and transporting the cut products;

and further including a stabilization unit having a cam (181) located between the first transport system (17) and the second transport system (19), said cam being positioned for engagement with the printed, cut products, and positively feeding said printed, cut products, received from the first transport system (17) to the second transport system (19).

* * * * *